US010920492B2

(12) United States Patent
Shattuck et al.

(10) Patent No.: US 10,920,492 B2
(45) Date of Patent: Feb. 16, 2021

(54) LADDER WITH SAFETY FEATURES

(71) Applicant: Intex Marketing Ltd., Tortola (VG)

(72) Inventors: Channing Shattuck, Bonsall, CA (US); William Wilkerson, Irvine, CA (US)

(73) Assignee: Intex Marketing Ltd., Tortola (VG)

( * ) Notice: Subject to any disclaimer, the term of this patent is extended or adjusted under 35 U.S.C. 154(b) by 38 days.

(21) Appl. No.: 15/287,357

(22) Filed: Oct. 6, 2016

(65) Prior Publication Data

US 2017/0101821 A1 Apr. 13, 2017

Related U.S. Application Data

(60) Provisional application No. 62/238,280, filed on Oct. 7, 2015.

(51) Int. Cl.

| | |
|---|---|
| ***E04H 4/14*** | (2006.01) |
| ***E06C 9/00*** | (2006.01) |
| ***E06C 7/00*** | (2006.01) |
| ***E06C 1/24*** | (2006.01) |
| ***E06C 1/39*** | (2006.01) |
| ***E06C 7/08*** | (2006.01) |

(Continued)

(52) U.S. Cl.

CPC ..... *E06C 7/006* (2013.01); *E04H 4/144* (2013.01); *E06C 1/24* (2013.01); *E06C 1/387* (2013.01); *E06C 1/39* (2013.01); *E06C 7/082* (2013.01); *E06C 7/182* (2013.01)

(58) Field of Classification Search

CPC ..... E06C 7/006; E06C 1/387; E06C 1/393; E06C 7/082; E06C 1/24; E06C 1/39; E06C 1/382; E04H 4/144

See application file for complete search history.

(56) References Cited

U.S. PATENT DOCUMENTS 579,328 A * 3/1897 McConnell ..... E06C 1/005 182/28
1,198,739 A * 9/1916 Marciniak et al. ..... E06C 1/005 182/156

(Continued)

FOREIGN PATENT DOCUMENTS

| | | |
|---|---|---|
| CN | 201190435 | 2/2009 |
| DE | 20208897 | 10/2002 |

OTHER PUBLICATIONS

Photograph of ladder from Kayak Pool Corporation, Photo Gallery, 1 page, available at http://www.kayakpools.com/corporate/KP_Hamburg_2.JPG, accessed on Nov. 5, 2010.

(Continued)

*Primary Examiner* — Daniel P Cahn

(74) *Attorney, Agent, or Firm* — Faegre Drinker Biddle & Reath LLP

(57) ABSTRACT

A ladder selectively allows or prevents user access to the ladder steps, such that the ladder can only be climbed when such access is allowed. For example, the ladder may only selectively allow ingress into a bathing enclosure, e.g., when operated by an adult, but always allows egress from the bathing enclosure by any user. The ladder includes one or more safety blocks moveable between a safety configuration, in which ingress is prevented or inhibited, and a ladder configuration, in which ingress and egress is permitted.

21 Claims, 12 Drawing Sheets

(51) Int. Cl.
*E06C 7/18* (2006.01)
*E06C 1/387* (2006.01)

(56) References Cited

U.S. PATENT DOCUMENTS 1,215,827 A * 2/1917 Lord ..... B63B 27/143 182/1
2,220,155 A * 11/1940 Jachim ..... E06C 9/06 182/1
2,864,542 A * 12/1958 Marryatt ..... B63B 27/14 182/156
3,026,961 A * 3/1962 Leverett ..... B63B 27/14 182/159
3,106,986 A 10/1963 Ray
3,225,863 A 12/1965 Ludlow
3,259,207 A * 7/1966 Schoeffler ..... E06C 9/10 182/161
3,288,248 A 11/1966 Gurian et al.
3,311,195 A 3/1967 Singer
3,372,772 A 3/1968 Singer
3,428,146 A 2/1969 Bair
3,447,633 A 6/1969 Montalto
3,586,124 A 6/1971 Kunzweller et al.
3,964,572 A 6/1976 Gannon
3,991,851 A 11/1976 Gannon
4,053,028 A * 10/1977 Loix ..... E06C 1/20 182/1
4,579,197 A 4/1986 Spurling
4,805,736 A * 2/1989 Byrnes, Jr. ..... E04H 4/144 182/156
4,811,767 A 3/1989 Kessler
5,343,977 A 9/1994 Bryan
5,441,126 A 8/1995 Orrick
D383,336 S * 9/1997 Van Der Merwe ..... E06C 1/00 D34/21
5,682,960 A 11/1997 Mobley et al.
6,189,653 B1 * 2/2001 Laug ..... E06C 1/39 182/152
6,425,711 B1 * 7/2002 Kiter ..... E01D 15/24 405/218
6,755,281 B2 6/2004 Saputo et al.
6,880,674 B1 4/2005 St-Hilaire
D525,369 S 7/2006 Houze
7,159,261 B2 * 1/2007 Carrigan ..... E01D 15/24 14/69.5
7,383,600 B2 * 6/2008 Carrigan ..... E01D 15/24 14/69.5
7,717,231 B2 5/2010 Horton
8,191,681 B2 6/2012 Lipniarski
8,191,682 B2 6/2012 Lipniarski
8,202,018 B2 6/2012 Lipniarski
D700,715 S 3/2014 Kubik
8,720,644 B2 5/2014 Naranjo et al.
8,925,686 B2 * 1/2015 Saint-Jalmes ..... B60R 3/02 182/156
9,074,384 B2 * 7/2015 Lin ..... E04H 4/144
9,587,434 B2 * 3/2017 Frick ..... E04F 11/002
9,895,576 B1 * 2/2018 Orgal ..... A63B 23/0458
2006/0076188 A1 * 4/2006 Horton ..... E06C 7/006 182/106
2007/0056797 A1 * 3/2007 Wang ..... B62B 1/12 182/21
2007/0193833 A1 8/2007 Nickelson
2009/0020360 A1 * 1/2009 May ..... B60R 3/02 182/1
2011/0072574 A1 3/2011 Hsiang Lin
2012/0228058 A1 9/2012 Dubois
2012/0312635 A1 12/2012 Randolph
2013/0117923 A1 5/2013 Toner
2015/0125245 A1 * 5/2015 Gallagher ..... B60R 9/042 414/462
2017/0152708 A1 * 6/2017 Lin ..... E06C 7/006
2017/0260811 A1 * 9/2017 Trudeau ..... E06C 1/26
2018/0127997 A1 * 5/2018 Hsu ..... E04H 4/06

OTHER PUBLICATIONS

Confer Plastics, Inc., The Leader in Ladders Brochure, 6 pages, published Jan. 2013, available at http://www.conferplastics.com/ConferBrochureLadder.pdf.
English Abstract of Chinese Patent No. CN 201190435 (Y).

* cited by examiner

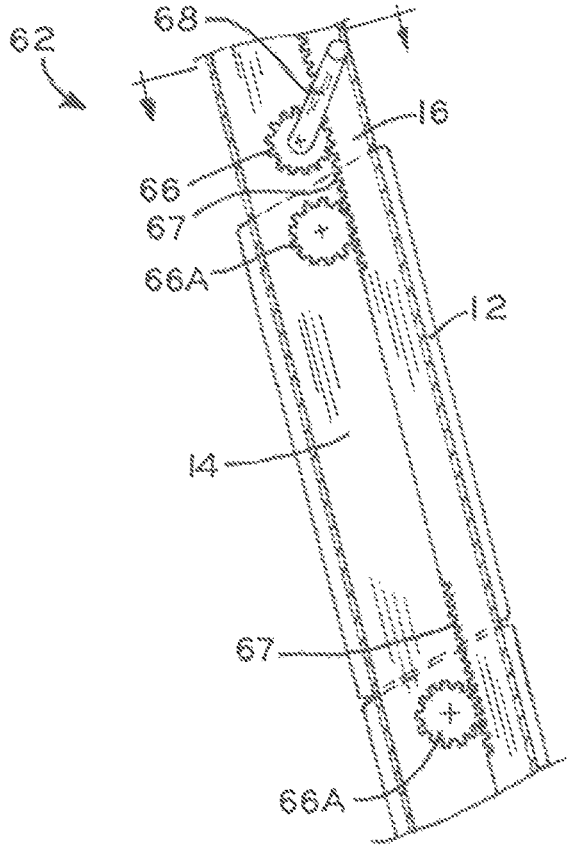
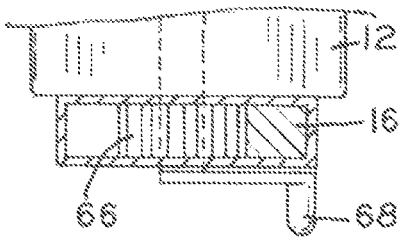
FIG_22
FIG_23
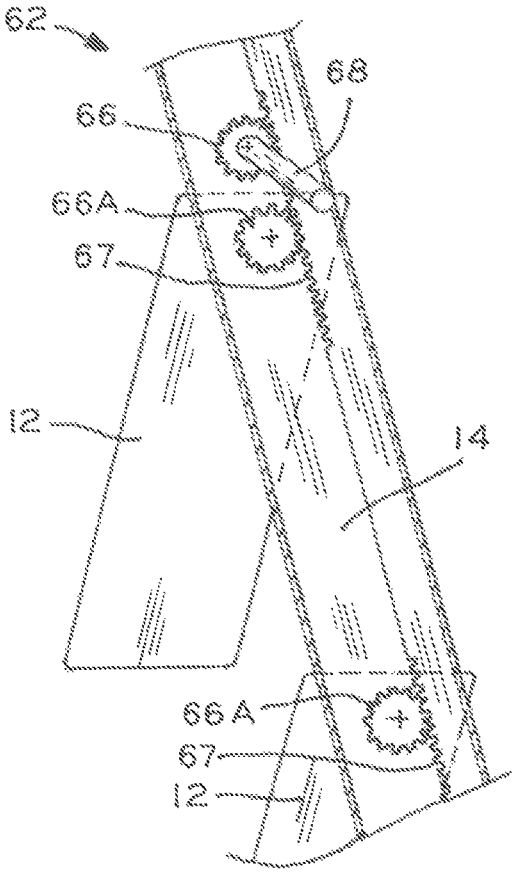
FIG_24

LADDER WITH SAFETY FEATURES

CROSS REFERENCE TO RELATED APPLICATIONS

This application claims the benefit under Title 35, U.S.C. § 119(e) of U.S. Provisional Application Ser. No. 62/238,280, entitled LADDER WITH SAFETY FEATURES and filed on Oct. 7, 2015, the entire disclosure of which is hereby expressly incorporated by reference herein.

FIELD OF THE DISCLOSURE

The present disclosure relates to ladders. More particularly, the present disclosure relates to ladders for use with above-ground pools or spas, and to methods for using the same.

BACKGROUND OF THE DISCLOSURE

An above-ground bathing enclosure, such as a pool or spa, may require a ladder to facilitate ingress into, and egress from, the bathing enclosure. In some cases, it may be desirable to restrict ingress into the bathing enclosure except by certain users, such as adults.

SUMMARY

The present disclosure provides a ladder which selectively allows or prevents user access to the ladder steps, such that the ladder can only be climbed when such access is allowed. For example, the ladder may only selectively allow ingress into a bathing enclosure, e.g., when operated by an adult, but may always allow egress from the bathing enclosure by any user. The ladder includes one or more safety blocks moveable between a safety configuration, in which ingress is prevented or inhibited, and a ladder configuration, in which ingress and egress is permitted.

According to an embodiment of the present disclosure, a ladder with safety features is provided. The ladder includes: a left upright; a right upright cooperating with the left upright to define a lateral gap; a lower ladder step having an upper step surface, the lower ladder step coupled to the left upright and the right upright and spanning the lateral gap; an upper ladder step having an upper step surface, the upper ladder step coupled to the left upright and the right upright, spanning the lateral gap, and cooperating with the lower ladder step to define a vertical gap; and a safety block spanning the lateral gap and the vertical gap, and disposed above the lower ladder step, the safety block being moveable with respect to the left upright and the right upright between a safety configuration in which the safety block covers the upper step surface of the lower ladder step and a ladder configuration in which the upper step surface of the lower ladder step is exposed, whereby a user cannot step on the upper step surface of the lower ladder step when the safety block is in the safety configuration.

According to another embodiment of the present disclosure, the ladder includes: a fixed portion comprising: a left upright; a right upright cooperating with the left upright to define a lateral gap; a ladder step having an exposed upper step surface, the ladder step coupled to the left upright and the right upright, the ladder step spanning the lateral gap; a moveable portion comprising: a second left upright; a second right upright cooperating with the second left upright to define a second lateral gap; a first safety block rotatably attached to the second left upright and the second right upright; and a motion member rotatably attached to the first safety block such that movement of the motion member rotates the first safety block, the first safety block having a top step surface.

According to yet another embodiment of the present disclosure, the ladder includes: a fixed portion comprising: a left upright; a right upright cooperating with the left upright to define a lateral gap; a ladder step coupled to the left upright and the right upright and spanning the lateral gap; a moveable portion comprising: a second left upright; a second right upright cooperating with the second left upright to define a second lateral gap; a lower ladder step having an upper step surface, the lower ladder step coupled to the second left upright and the second right upright, the lower ladder step spanning the second lateral gap; an upper ladder step having an upper step surface, the upper ladder step coupled to the left upright and the right upright, spanning the second lateral gap, and cooperating with the lower ladder step to define a vertical gap; and a safety block spanning the lateral gap and the vertical gap, and disposed above the lower ladder step, the safety block being moveable with respect to the left upright and the right upright between a safety configuration in which the safety block covers the upper step surface of the lower ladder step and a ladder configuration in which the upper step surface of the lower ladder step is exposed, whereby a user cannot step on the upper step surface of the lower ladder step when the safety block is in the safety configuration.

According to still yet another embodiment of the present disclosure, a method is provided for using a ladder assembly. The method includes: pulling downwards on a handle to expose a set of steps; ascending said set of steps while said set of steps are exposed; and releasing said handle to cover said steps.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein:

FIG. 22 is partial cross-section, top plan view of an exemplary rack and pinion mechanism for the pool ladder of FIG. 1 according to an embodiment of the present disclosure;

FIG. 23 is partial cross-section, side elevation view of the exemplary rack and pinion mechanism of FIG. 22 for the pool ladder of FIG. 1, shown in a safety configuration in which the bathing enclosure is inaccessible to a child; and FIG. 24 is partial cross-section, side elevation view of the exemplary rack and pinion mechanism of FIG. 22 for the pool ladder of FIG. 1, shown in a ladder configuration after actuation by an adult.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
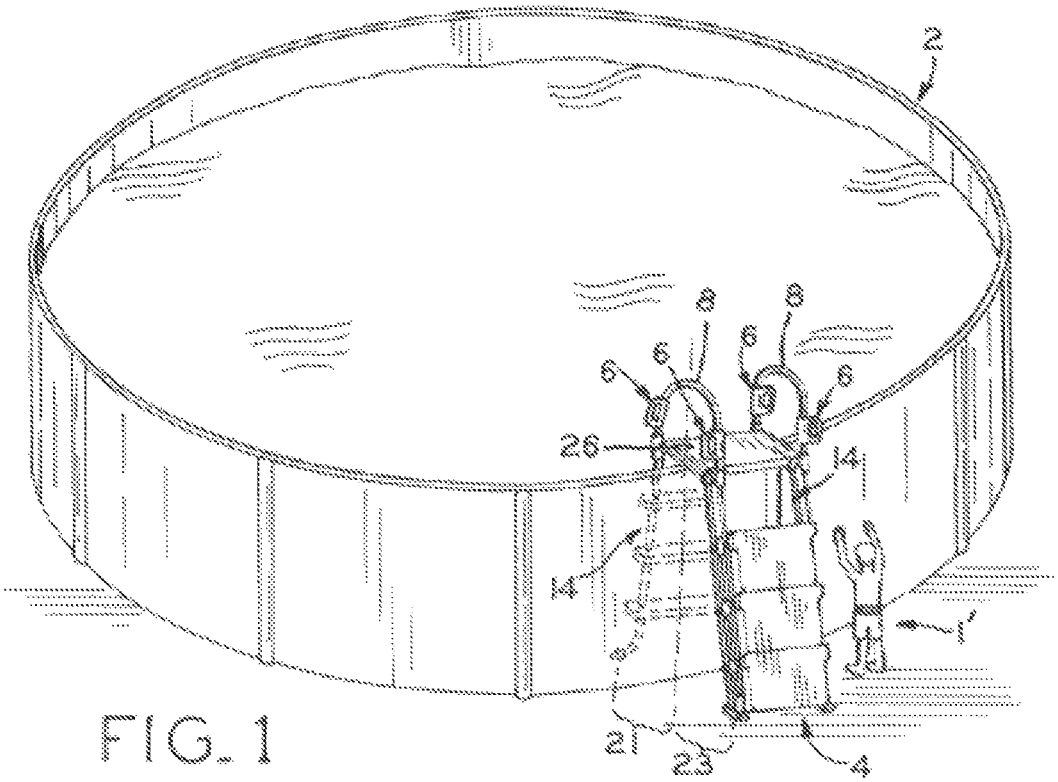
FIG. 1 is a perspective view of a bathing enclosure having a pool ladder made in accordance with the present disclosure, illustrated in a safety configuration such that the bathing enclosure is inaccessible to a child.

The present disclosure relates to ladders, such as ladders 4 and 40 described in detail below, which are configurable to selectively allow or prevent access to steps of the ladder. Ladders 4, 40 may be reconfigurable only by qualified users, e.g., adults, in order to prevent use by children. Specifically, the present disclosure provides ladders 4, 40 having a restriction mechanism configurable in a safety configuration, in which a user is unable to climb the ladder as the step surfaces are unexposed and provide no purchase for a user's foot. Ladders 4, 40 also have a ladder configuration, in which a user is able to climb the ladder as the steps are exposed and provide ample purchase. In an exemplary embodiment, only an adult user is able to toggle from the safety configuration to the ladder configuration, as the toggling control is elevated above a child's reach.

1. First Embodiment

FIGS. 1-4 show a ladder 4 made in accordance with the present disclosure and configured for use with at least an above-ground bathing enclosure 2, such as an above-ground pool or spa as illustrated. As shown in FIGS. 1-4, ladder 4 has a fixed portion 21 positioned along an inner side of bathing enclosure 2 and a moveable portion 23 positioned along an outer side of bathing enclosure 2. Fixed and moveable portions 21, 23 of ladder 4 each include a pair of uprights 14, with fixed portion 21 having a plurality of ladder steps 10 spanning the lateral gap 100 between uprights 14. For example, the pair of uprights is a left upright and a right upright taken from the perspective of a user 1 such that a user 1 will grasp left upright with their left hand and right upright with their right hand when entering or exiting bathing enclosure 2. Furthermore, a lower ladder step 10*a* and an upper ladder step 10*b* create a vertical gap 104 therebetween.

Fixed portion 21 is constructed similar to a conventional ladder, with steps 10 providing for egress from the bathing enclosure 2. As described further below, steps 19 on moveable portion 23 are only selectively exposed to facilitate ingress to bathing enclosure 2.

Figure 2:
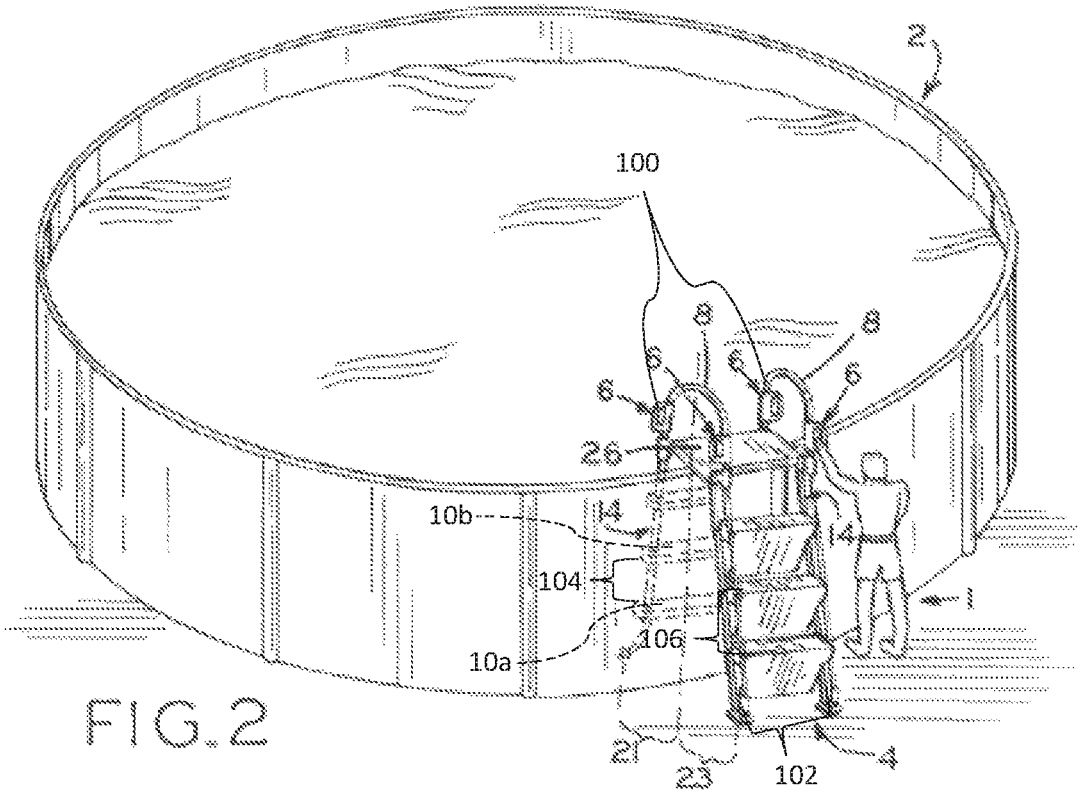
FIG. 2 is a perspective view of the bathing enclosure and pool ladder of FIG. 1, shown in a ladder configuration after actuation by an adult.

Ladder 4 includes handles or railings 8 coupled to respective upper ends of uprights 14 and extending above an upper lip of bathing enclosure 2, as shown in FIGS. 1 and 2. Also included in ladder 4 is a bridge or platform 26 spanning the gap between uprights 14 of both fixed portion 21 and moveable portion 23 and is located above safety blocks 12 (described in further detail below) and ladder steps 10, which can be used by a user 1 for safe passage from fixed portion 21 to moveable portion 23 and vice versa.

The plurality of steps 10 on fixed portion 21 of ladder 4 are stationary and remain available at all times to users wishing to exit bathing enclosure 2. The moveable portion 23 includes a plurality of safety blocks 12 moveable between a safety configuration shown in FIG. 1 and a ladder configuration shown in FIG. 2. More particularly, when in the ladder configuration most clearly illustrated in FIGS. 5 and 6, the tread of the exposed surface 19 of safety block 12 is generally parallel to the ground so as to receive a user's foot and provide ample purchase as the user ascends moveable portion 23, such that the tread of the exposed surface 19 serves as a step surface. Like the plurality of steps 10 on fixed portion 21 of ladder 4, the exposed step surfaces 19 on moveable portion 23 of the ladder 4 span a lateral gap 102 between uprights 14 and create a vertical gap 106 between the exposed step surfaces 19. However, when in the safety configuration illustrated in FIGS. 3 and 4, the tread of exposed surface 19 of safety block 12 is angled relative to the ground, faces away from a user seeking access to bathing enclosure 2, and may be hidden by the adjacent lower surface of the next neighboring block 12. Thus, when ladder 4 is in the safety configuration, a user is not able to gain purchase with his/her foot on any of the steps and therefore cannot use ladder 4 to enter bathing enclosure 2.

Figure 8:
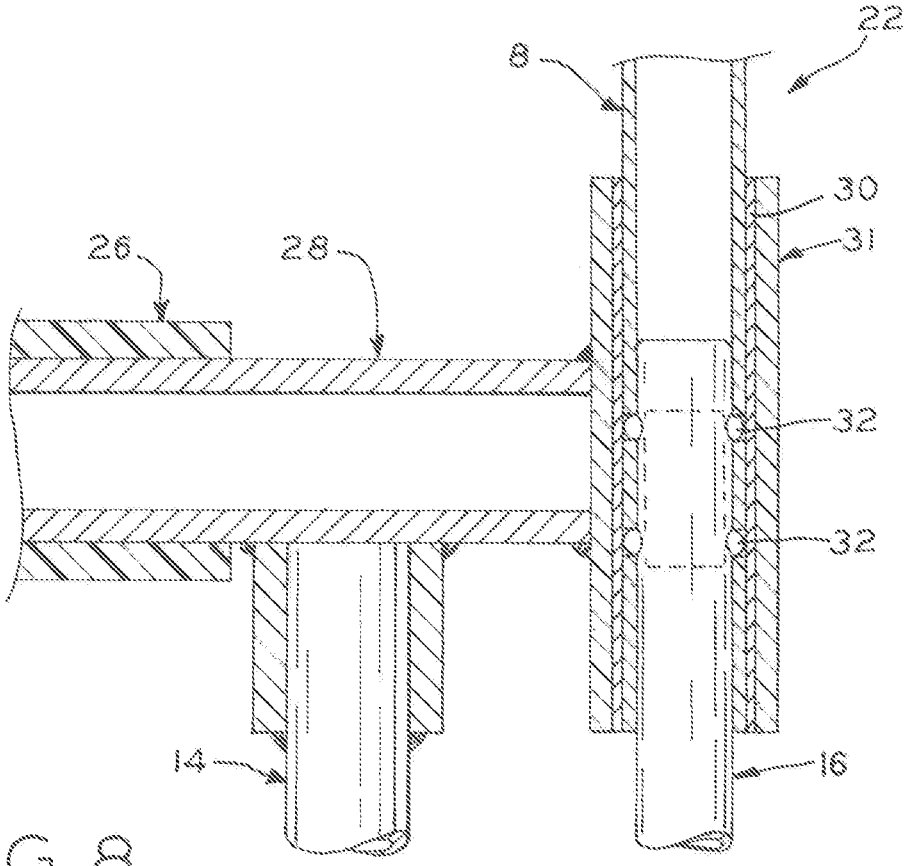
FIG. 8 is a partial cross-section, side elevation view of another connecting joint of the pool ladder shown in FIG. 4.

Referring now to FIG. 8, moveable portion 23 of ladder 4 includes connecting joint 22 which operably couples each respective upright 14, motion member 16, crossbar 28, and an upper member formed at the end of railing 8. Motion member 16, which cooperates with handle 6 to actuate safety blocks 12 as further described below, is oriented substantially parallel with upright 14 of moveable portion 23. Safety blocks 12 span the gap between motion member 16 and uprights 14, as best illustrated in the side elevation view of FIG. 4, and span the lateral gap 102 between left upright and right upright 14. In the illustrative embodiment of FIGS. 4 and 6, safety blocks 12 are attached to uprights 14 and motion members 16 by pivot screws 18, 20, respectively. It is also contemplated that other arrangements may be used to pivotably attach safety blocks 12 to uprights 14 and motion members 16, such as a set of screws linked by a cross bar.

Referring still to FIG. 8, connection joint 22 includes two separate connections: a first connection between platform 26 and upright 14 and a second connection between upper member 8 and motion member 16. The first connection is located at the interface between upright 14 and crossbar 28. This connection rigidly links upright 14 to platform 26 and cooperates with connection joint 24 (FIG. 7) to provide stability for ladder 4. The second connection involves upper member 8 and motion member 16. Motion member 16 is slidably assembled to upper member 8 and includes a catch assembly disposed on motion member 16. The catch assembly includes detents 32. Detents 32 provide a secure fit for motion member 16 and fixes motion member 16 to upper member 8, such that upper member 8 cannot slide out of motion member 16 when ladder 4 is in use.

When motion member 16 is slidably assembled to upper member 8, detents 32 move radially inward to allow motion member 16 to move within upper member 8. Once a portion of motion member 16 is slid within upper member 8, detents 32 are biased to expand radially outwardly to fill respective detent recesses (FIG. 8). The biasing force on detents 32 of upper member 8 provides a secure connection between motion member 16 and upper member 8. When so secured, upper member 8 and motion member 16 move in unison, e.g., when upper member 8 moves downward, motion member 16 also moves downward depending on the nature of the force applied to upper member 8. In the illustrated embodiment, connection joint 22 includes bushing 30 which facilitates movement of upper member 8 within the outer tube 31 of connection joint 22, which in turn is fixed to crossbar 28 as shown. Bushing 30 is made of a lubricious material such as bronze or ultra-high molecular weight (UHMW) polyethylene, or any other suitable lubricious bushing materials.

Figure 7:
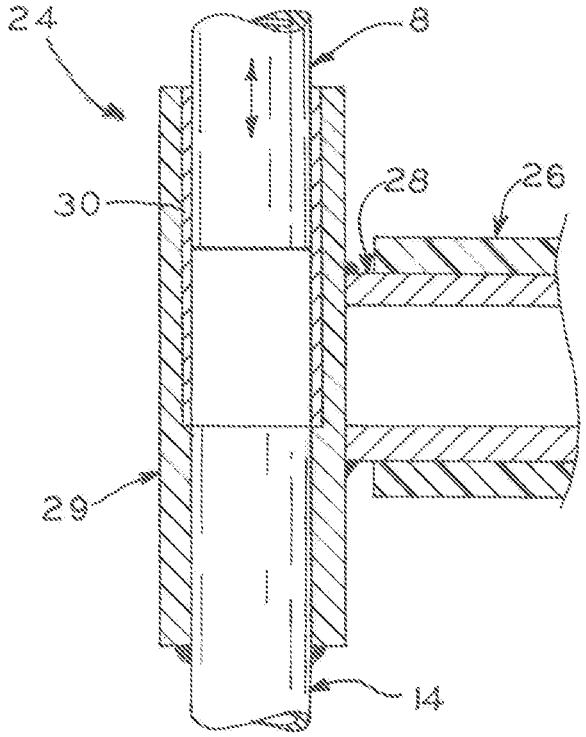
FIG. 7 is a partial cross-section, side elevation view of a connecting joint of the pool ladder shown in FIG. 4.

Referring now to FIG. 7, fixed portion 21 of ladder 4 includes connecting joint 24 which operably couples each respective upright 14 and upper member 8. Upright 14 is fixed to outer tube 29 of connecting joint 24, and upper member 8 is slidably received in outer tube 29. Because upright 14 is affixed to outer tube 29, movement of upper member 8 will not result in movement of upright 14. Connecting joint 24 also includes bushing 30 located at the interface between outer tube 29 and the outside surface of upper member 8. Bushing 30 facilitates movement of upper member 8 within connection joint 24, in similar fashion as described above with respect to connection joint 22.

In an alternative embodiment, the linear sliding interface between bushing 30 and motion member 16 and upper member 8 may be replaced with an alternative actuation mechanism, such as a rack and pinion mechanism. Exemplary rack and pinion systems 62 which may be applied to ladder 4 are shown in FIGS. 22-24. A torque arm, shown as a handle 68, may extend from pinion 66 and may be rotatably coupled to safety block 12 via a rack-like structure 67 formed on motion member 16. Pinion 66 is rotatably coupled to a stationary structure, illustratively upright 14. Crossbar 28 may also be a suitable stationary structure for mounting pinion 66 in some applications. A second pinion 66A is fixed to an upper portion of safety block 12, and also engages rack 67. Although handle 68 is shown on only one of the two uprights 14 in FIGS. 22-24, it is contemplated that a pair of handles 68 may be provided with one on each side (i.e., left and right) in order to enable two-handed actuation.

When handle 68 is actuated, pinion 66 rotates, and engagement between pinion 66 and rack 67 causes downward translation of motion member 16. As motion member 16 moves downwardly, engagement between rack 67 and pinion 66A causes safety blocks 12 to rotate inwards into the actuated position. Once handle 68 is fully actuated as shown in FIG. 24 safety block is in the fully actuated position as discussed herein. Additional rack-like structures 67 may be provided along the axial length of motion member 16, and engage additional pinions 66A for each safety block 12. Thus, actuation of handle 68 actuates all safety blocks simultaneously. Using rack and pinion system 62 provides a robust and reliable interface between handle actuation (which is a pivotable motion) and the resulting linear movement of motion member 16.

In an alternative embodiment, handle 68 and pinion 66 may be omitted, and motion member 16 may be linearly translated by direct application of force (e.g., a user may simply slide motion member 16 up and down). This motion still simultaneously actuates pinions 66A via racks 67, actuating block. In applications where the mechanical advantage of handle 68 is not needed, this alternative embodiment may provide a simpler solution.

FIG. 2 illustrates actuation of ladder 4, in which a user 1 pushes or pulls down on handles 6 of ladder 4 to actuate safety blocks 12 from the safety configuration (FIG. 1) to the ladder configuration (FIG. 2), as described in further detail below. After such actuation and for a predetermined length of time, safety blocks 12 on moveable portion 23 of ladder 4 remain actuated to allow the user to climb moveable portion 23 and enter bathing enclosure 2. After the predetermined length of time has elapsed, moveable portion 23 may automatically return to the safety configuration, as further described below. As such, the safety configuration illustrated in FIG. 1 may be the default position. In an exemplary embodiment, ladder 4 has any number of safety blocks 12 disposed between steps uprights 14, and actuation of handle 6 simultaneously actuates safety blocks 12.

Figure 3:
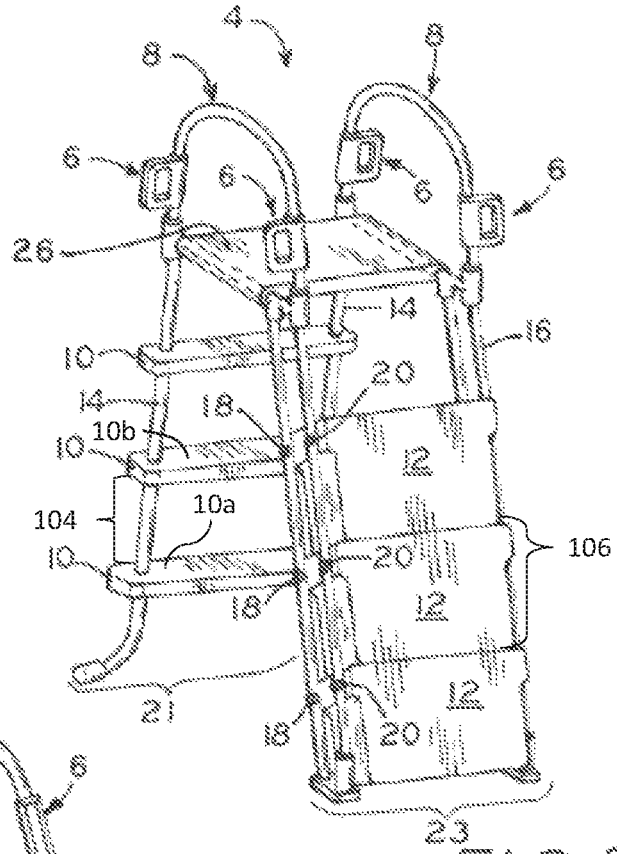
FIG. 3 is a perspective view of the pool ladder of FIG. 1, shown in its safety configuration.
Figure 4:
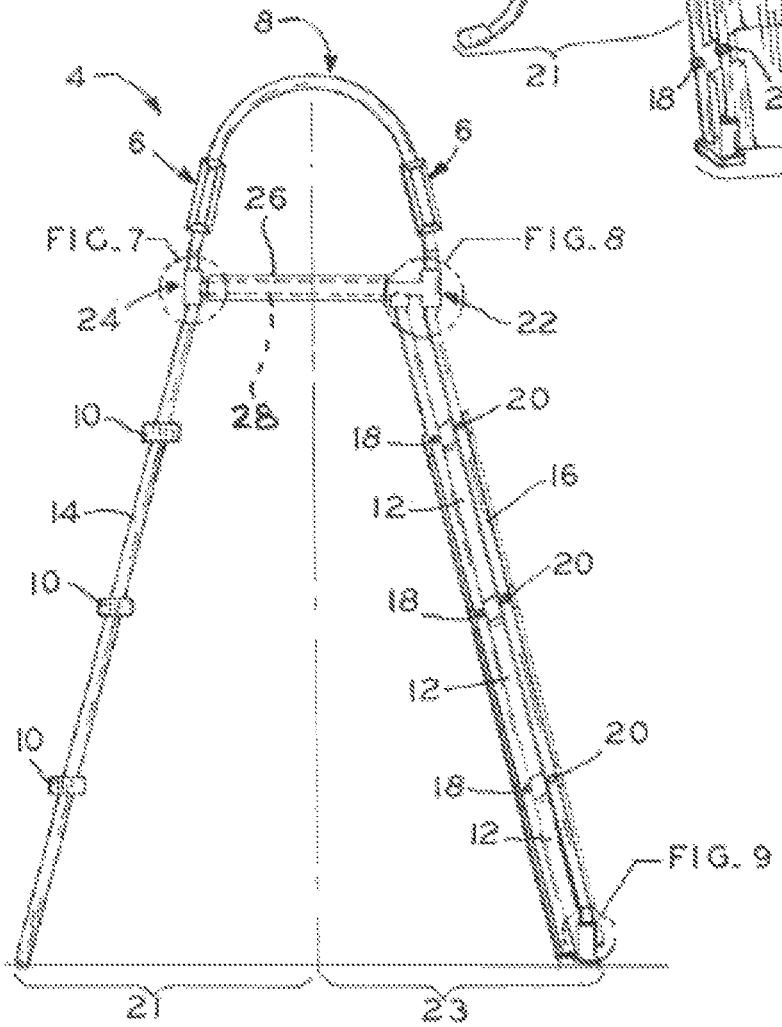
FIG. 4 is a side elevation view of the pool ladder of FIG. 3.

As best seen in FIGS. 3 and 4, safety blocks 12 are flush with one another in the safety configuration, and may have outer surfaces substantially coplanar with one another. In this configuration, moveable portion 23 of ladder 4 provides no purchase for a user's foot such that the ability to climb ladder 4 is substantially foreclosed.

Figure 5:
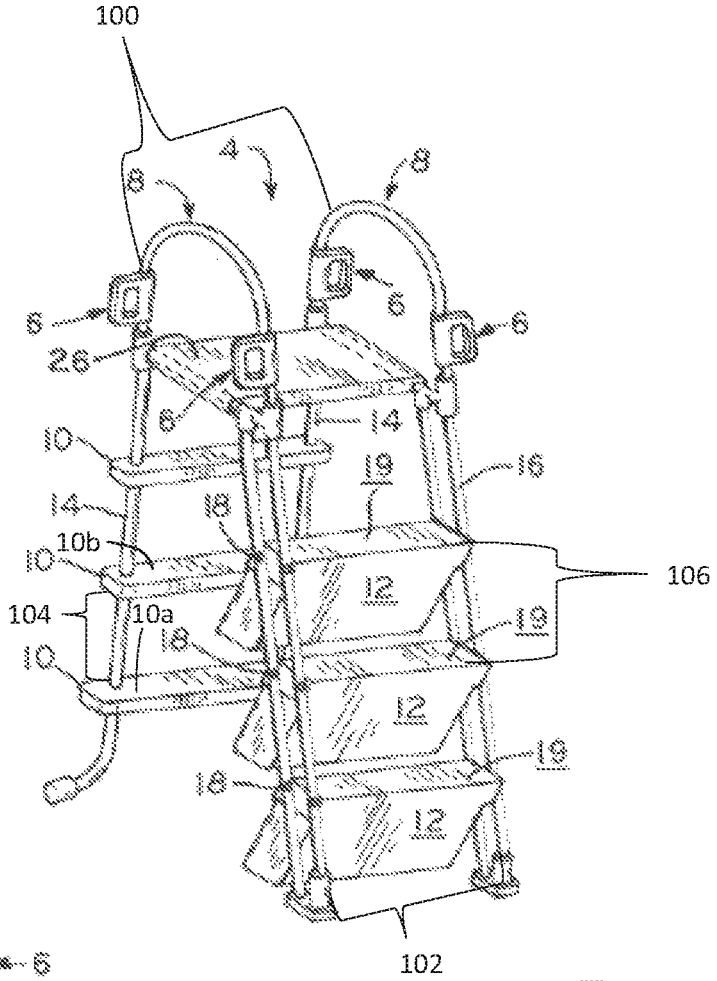
FIG. 5 is a perspective view of the pool ladder of FIG. 2, shown in its ladder configuration.
Figure 6:
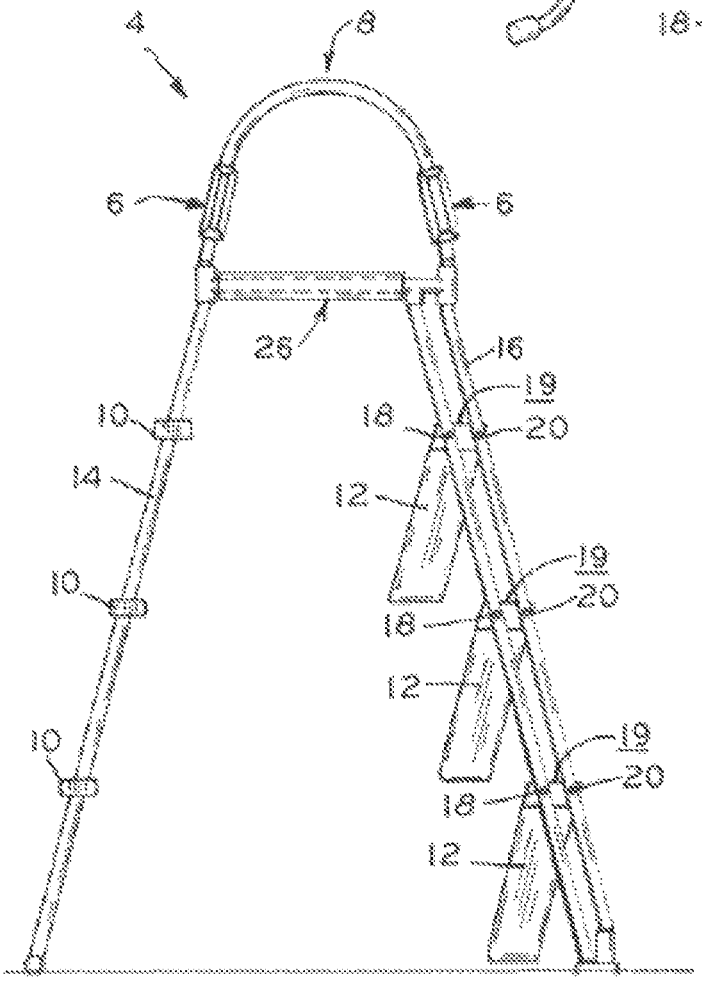
FIG. 6 is a side elevation view of the pool ladder of FIG. 5.

FIGS. 5, 6, 14, and 15 show ladder 4 in its ladder configuration. In the illustrated embodiment, toggling from the safety configuration to the ladder configuration occurs when adult 1 pulls down on handle 6 as shown in FIG. 2. Similarly, a user positioned on platform 26 may push down on handle 6 to effect toggling. Applying a downward force on handle 6 translates motion member 16 downwards and rotates safety blocks 12 into their respective actuated positions. The axes of rotation of safety blocks 12 are coincident with the axis of pivot screw 18, which is coupled to upright 14 of moveable portion 23 and to a portion of safety block 12. Pivot screw 18 remains stationary during actuation of handle 6, and thereby provides the stationary pivot point about which safety block 12 rotates. Thus, as motion member 16 is translated downward by actuation of handle 6, pivot screws 20 also translate relative to pivot screw 18 causing safety block 12 to rotate. As illustrated in FIGS. 5 and 6, pivot screws 18, 20 are both located near tread surface 19, such that rotation of safety blocks 12 swings the lower portions of safety blocks 12 inwardly and away from the user. This inward swing exposes and levels tread surfaces 19, enabling placement of the foot of user 1 thereupon to ascend or descend moveable portion 23 of ladder 4.

The above-described transition between safety and ladder configurations allows an adult user 1 to selectively enable the ladder configuration by manipulation of handles 6, as shown in FIG. 1. However, handle 6 is located on upper member 8 such that it is too high for a child to reach, as shown in FIG. 1, such that ladder 4 prevents a child user 1' from effecting actuation. This protects child 1' from entering bathing enclosure 2 except under the supervision of an adult user 1.

Figure 9:
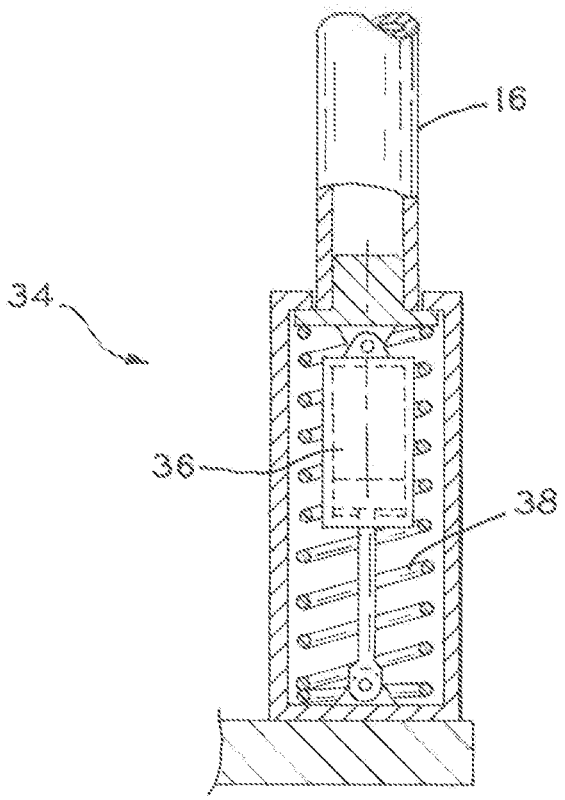
FIG. 9 is a partial cross-section, side elevation view of a spring and damper system of the pool ladder shown in FIG. 4.

Ladder 4 may also transition automatically back to its safety configuration (FIG. 3) from the ladder configuration (FIG. 5). This automatic transition may be accomplished by a spring-and-damper mechanism, an exemplary embodiment of which is shown in FIG. 9. As mentioned earlier, actuation of handle 6 translates motion member 16 downwards such that safety block 12 rotates about stabilizing screws 18, 20. Spring 38 is also compressed when motion member 16 is translated downwards. Upon release of handle 6, ladder 4 begins transitioning from its ladder configuration to its safety configuration as spring 38 biases motion member 16 upwardly. As motion member 16 translates upwards, safety block 12 slowly rotates back into its safety configuration.

Damper 36 acts against the bias of spring 38 and limits the speed with which the biasing force of spring 38 translates motion member 16 upwardly, as also shown in FIG. 9. In an exemplary embodiment, the counteracting force of damper 36 is calibrated to permit ladder 4 to return to its safety configuration only after a predetermined length of time. This time delay prevents safety blocks 12 from abruptly returning to their safety configurations (FIG. 3) immediately upon release of handle 6 by user 1. This gives user 1 time to safely ascend or descend ladder 4 via the exposed surfaces 19 of safety blocks 12 before ladder 4 returns to its safety configuration.

2. Second Embodiment

FIGS. 10-13 show ladder 40 made in accordance with the present disclosure and configured for use with bathing enclosure 2. Ladder 40 is similar in overall structure and function to ladder 4 described in detail above, and structures of ladder 40 have names corresponding to corresponding structures of ladder 4. However, as further described below, ladder 40 has safety blocks 52 which translate linearly to expose a separate set of steps 54, rather than pivoting blocks 12 to form steps.

As shown in FIGS. 10-13, ladder 40 has fixed portion 43 positioned along an inner side of bathing enclosure 2 and moveable portion 45 positioned along an outer side of bathing enclosure 2. Fixed and moveable portions 43, 45 each include a pair of uprights 42 having a plurality of steps 50, 54 spanning the gap therebetween for ingress to and egress from the bathing enclosure 2 similar to what is shown in FIGS. 1 and 2. For example, the pair of uprights is a left upright and a right upright taken from the perspective of a user 1 such that a user will grasp left upright with their left hand and right upright with their right hand when entering or exiting bathing enclosure 2. Also included in ladder 40 is a bridge or platform 56 spanning the gap between uprights 42 and located above ladder steps 50, 54, which can be used by user 1 (FIG. 1) for safe passage from fixed portion 43 to moveable portion 45 and vice versa.

Fixed portion 43 is constructed similar to a conventional ladder, with steps 50 providing for egress from the bathing enclosure. As described further below, steps 54 on moveable portion 45 are only selectively exposed to facilitate ingress to bathing enclosure 2.

Figure 16:
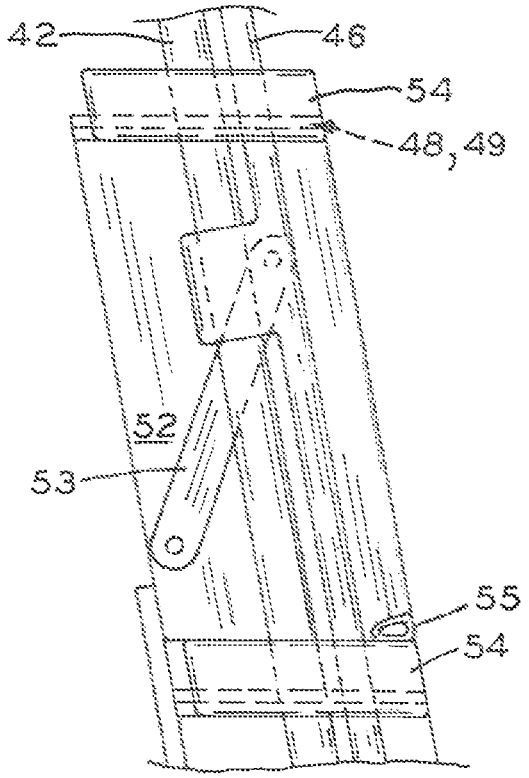
FIG. 16 is a partial, side elevation view of a ladder step of the pool ladder of FIG. 11.
Figure 17:
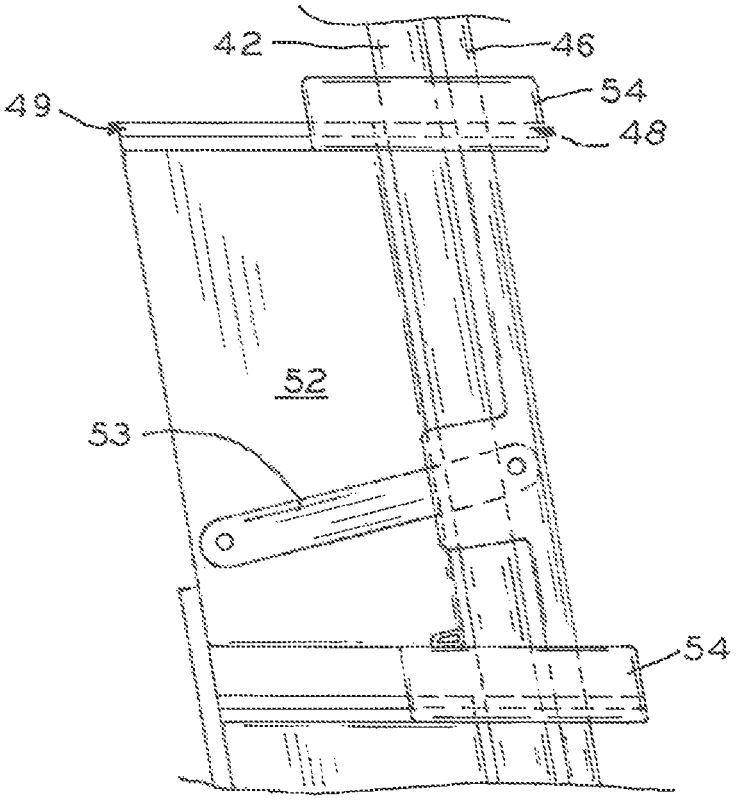
FIG. 17 is a partial, side elevation view of a ladder step of the pool ladder of FIG. 13.

Moveable portion 45 includes a plurality of steps 54 which also span the gap between uprights 42, and which are also stationary. However, each step 54 includes groove 48 located on a lower surface which is sized and configured to engage a corresponding tongue 49 (FIGS. 16 and 17) on the adjacent safety block 52. Safety blocks 52 are disposed between steps 54, with tongue 49 of safety blocks 52 fitting within groove 48 to restrict the motion of safety blocks 52 to a linear path as described below. Similar to safety blocks 12 described above, safety blocks 52 are sized to span the gap between uprights 42, as illustrated in FIGS. 10-13. Thus, groove 48 and tongue 49 of safety block 52 interfit with a tongue-and-groove arrangement.

Figure 19:
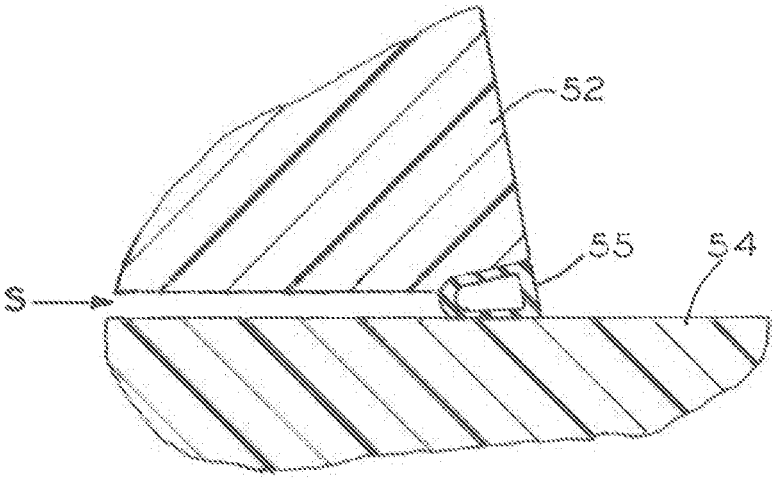
FIG. 19 is a partial cross-section, side elevation view of an interface between a safety block and the ladder step of the pool ladder of FIG. 10.

Affixed to the bottom surface of safety block 52 is a gasket 55 as shown in FIG. 19. Gasket 55 interfaces with an upper surface of the next adjacent ladder step 54 positioned beneath safety block 52. Gasket 55 is made of a resiliently deformable material such as rubber or synthetic rubber alternatives. Gasket 55 prevents a user's foot from being pinched between safety block 52 and ladder step 54 as safety block 52 moves between the safety and ladder configurations. In addition, gasket 55 is positioned and oriented to fill the space S between the lower surface of safety block 52 and the upper surface of ladder step 54 in its safety configuration. Gasket 55 ensures that there is not enough space between safety block 52 and ladder step 54 to allow a user gain purchase on ladder step 54, and therefore, prevents users (such as child 1', shown in FIG. 1) from climbing the ladder 40.

Figure 13:
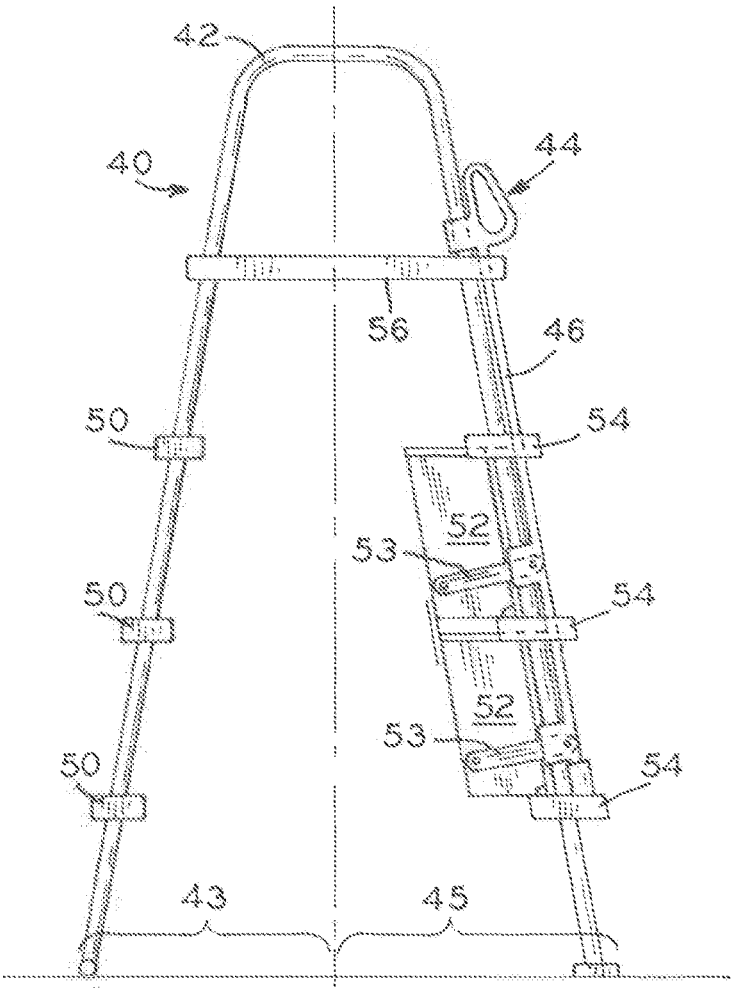
FIG. 13 is a side elevation view of the pool ladder of FIG. 12.
Figure 14:
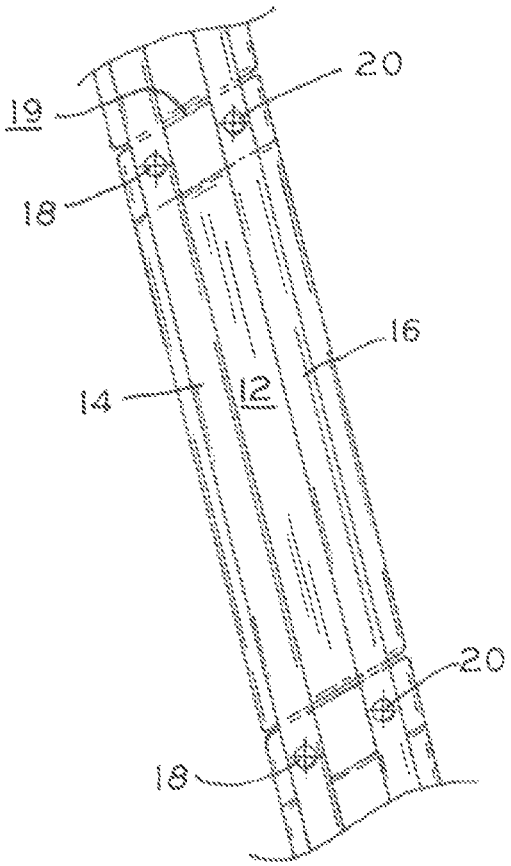
FIG. 14 is a partial, side elevation view of a ladder step of the pool ladder of FIG. 4.
Figure 15:
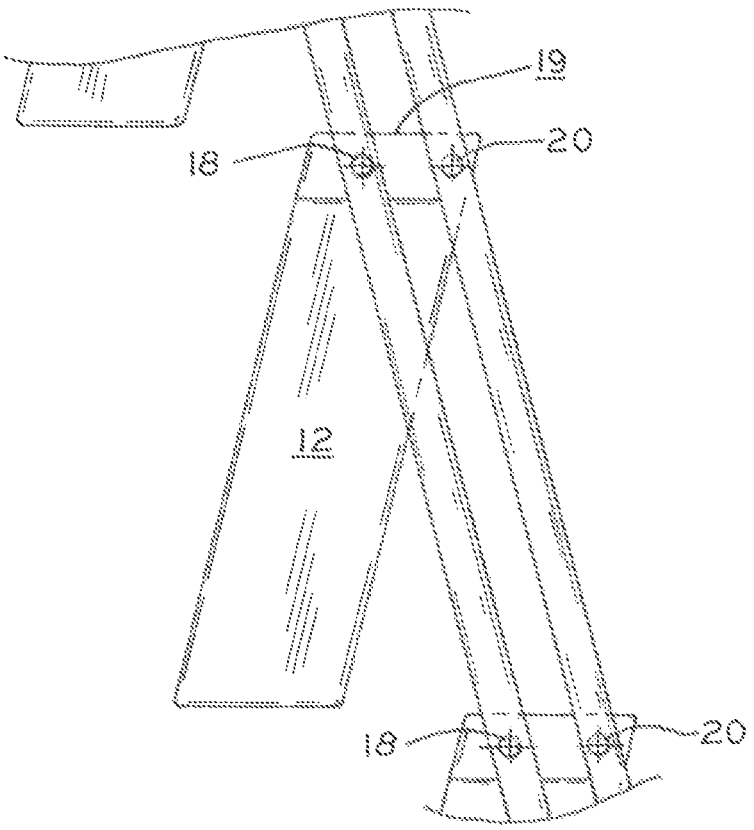
FIG. 15 is a partial, side elevation view of a ladder step of the pool ladder of FIG. 6.

Referring now to FIG. 13, moveable portion 45 also includes handles 44 slidably attached to uprights 42. Handles 44 are operably coupled to elongated member 46, linkage 53, and safety blocks 52. Elongated member 46, which cooperates with handles 44 and linkage 53 to actuate safety blocks 52 as further described below, is oriented substantially parallel with uprights 42 of moveable portion 45.

Figure 10:
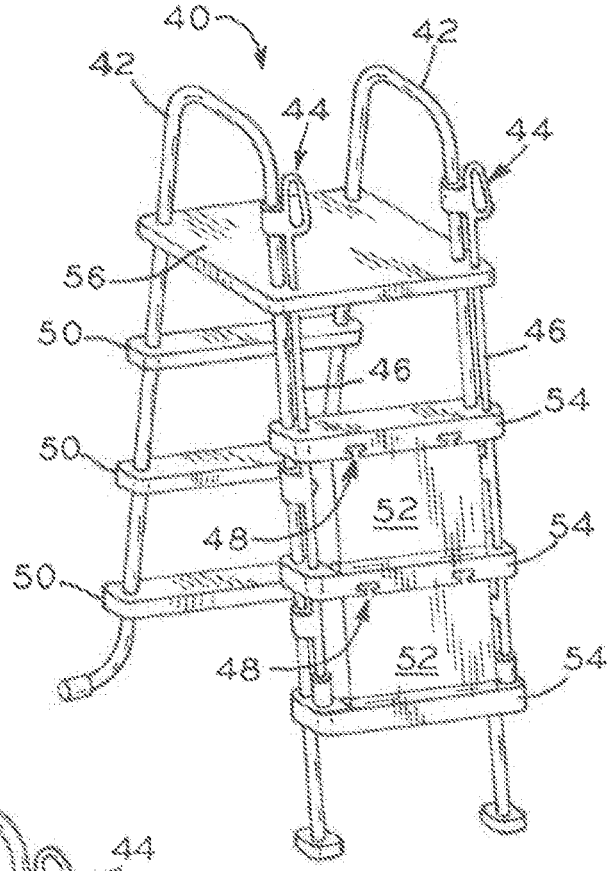
FIG. 10 is a perspective view of another pool ladder made in accordance with the present disclosure, shown in its safety configuration.
Figure 12:
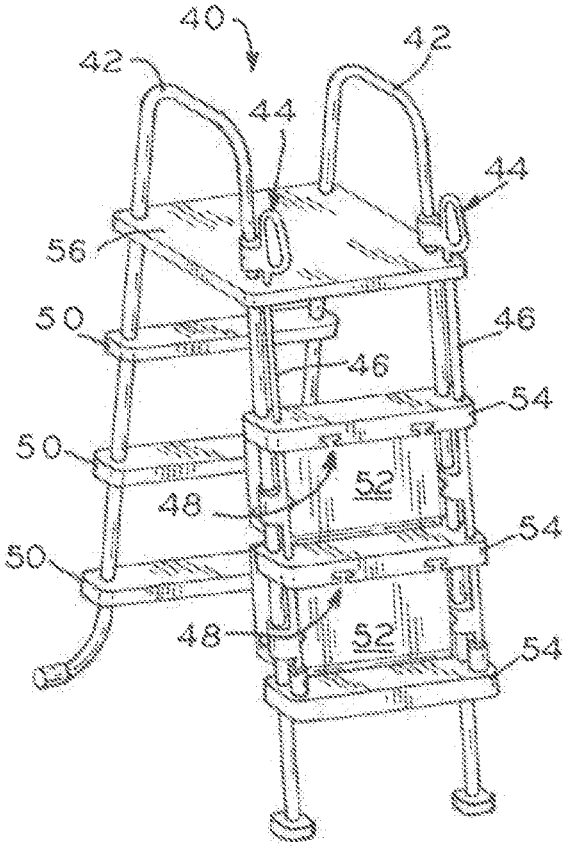
FIG. 12 is a perspective view of the pool ladder of FIG. 10, shown in its ladder configuration.

The moveable portion 45 is selectively configurable between a safety configuration shown in FIG. 10 and a ladder configuration shown in FIG. 12. When ladder 40 is in the safety configuration illustrated in FIG. 10, the tread of steps 54 is concealed by the adjacent lower surface of the neighboring safety blocks 52 disposed above the step 54. In addition, the outer surfaces of safety blocks 52 are flush with one another and with the adjacent outer surfaces of steps 54. In an exemplary embodiment, these outer surfaces may all be substantially coplanar. Thus, when ladder 40 is in the safety configuration, a user is not able to gain purchase with his/her foot on any of the steps and therefore cannot use ladder 40 to enter bathing enclosure 2. However, when ladder 40 is in the ladder configuration illustrated in FIG. 12, safety blocks 52 are positioned inward from the treads of steps 54 such that the treads of steps 54 are exposed to receive a user's foot and provide ample purchase.

Figure 11:
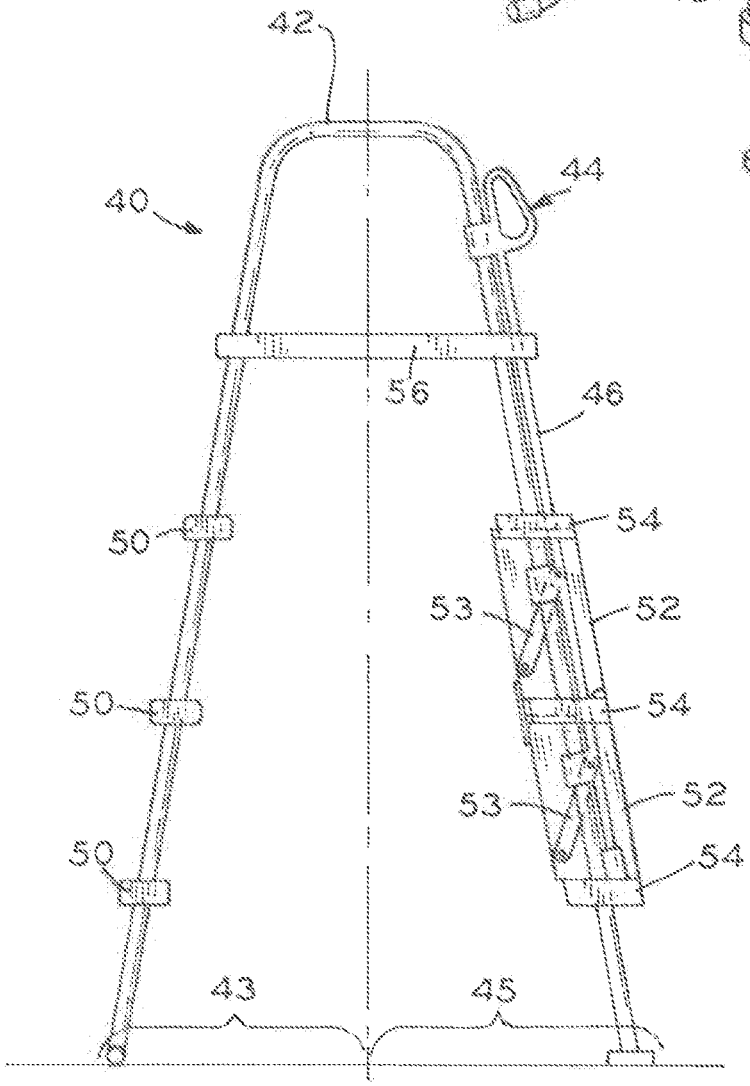
FIG. 11 is a side elevation view of the pool ladder of FIG. 10.

In one illustrative embodiment, as shown in FIGS. 11 and 13, when a user pulls or pushes down on handles 44 of ladder 40, elongated member 46 translates downwardly. As elongated member 46 translates downwardly, the pivot point between linkage 53 and elongated member 46 also translates downwardly, pivoting linkage 53 in a clockwise direction from the perspective of FIGS. 11 and 13. This pivoting pushes the pivot point between linkage 53 and block 52 inwards away from the user of ladder 40. As shown in FIGS. 12, 13, 16, and 17, as the respective pivot points between linkages 53 and blocks 52 move inwardly, they urge respective safety blocks 52 inwardly as well. Because tongue 49 of safety block 52 is engaged with groove 48 as noted above, the inward urging from linkage 53 translates safety block 52 inwardly along a substantially linear path defined by groove 48. After such inward translation, the resulting configuration is the ladder configuration shown in FIG. 12, in which the respective treads of ladder steps 54 are exposed for a user to ascend or descend ladder 40. In an exemplary embodiment, ladder 40 has any number of steps 54 with any number of safety blocks 52 disposed between steps 54, and actuation of handle 44 simultaneously translates safety blocks 52 inwardly.

It is also contemplated that a rack and pinion system may be used in place of the movement mechanism shown in FIGS. 11 and 13 to convert the downward movement of elongated member 46 via handles 44 to inward movement of safety blocks 52. An exemplary rack and pinion system suitable for use in place of linkage 53 is similar to rack and pinion 62 shown in FIGS. 22-24. In one embodiment, a rack (similar to rack 67) may be a part of or fixed to elongated member 46. A mating pinion (similar to pinion 66A) may be rotatably coupled to an adjacent stationary structure, e.g., upright 42. In one embodiment, a torque arm (similar to linkage 53) may extend from each of the pinions and be rotatably coupled to each adjacent safety block 52. When the rack formed on elongated member 46 translates downwards via actuation of handles 44, the rack engages the pinions causing them to rotate. As the pinion rotates, the torque arm also rotates toward a horizontal position, similar to actuation of linkage 53, such that safety block 52 is translated inwards.

In another embodiment, there may be two racks (similar to 67) involved in the rack and pinion system. In this configuration, there is a first rack that is part of or fixed to elongated member 46, as described above, and a second rack that is fixed to a safety block 52. By contrast to the embodiment described above, the second rack is utilized in place of a torque arm or handle extending from the pinion. Rather, the pinion (similar to pinion 66A) is rotatably coupled to a stationary structure, e.g., upright 42, and operably engaged with both racks. When elongated member 46 translates downwards via actuation of handles 44, the first rack positioned on upright 42 engages the pinion causing it to rotate. As pinion 66 rotates, it engages the second rack positioned on safety blocks 52 such that the rotation of the pinion is converted into linear movement of the second rack and a corresponding translation of safety block 52 inwards.

It is also contemplated that a further rack and pinion system 62 may be used in place of the linear movement mechanism provided by handles 44 and its surrounding structures. An exemplary rack and pinion system 62 is shown in FIGS. 22-24 and described in detail above with respect to ladder 4. Similar to ladder 4, the rack may be fixed to elongated member 46 and pinion 66 may be rotatably coupled to a stationary structure, such as upright 42, in order to convert pinion rotation (such as via handle 68 extending from the pinion) to linear movement of uprights 42 in the same manner as described above.

In an exemplary embodiment, safety blocks 52 may automatically return to the safety configuration (FIG. 10) after a predetermined length of time as described in further detail below. As such, the safety configuration of the illustrative embodiment of ladder 40 may be the default position.

Figure 18:
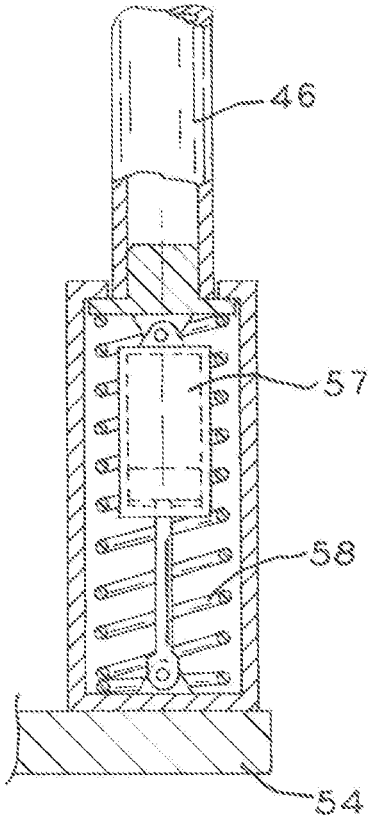
FIG. 18 is a partial cross-section, side elevation view of a spring and damper mechanism for the pool ladder of FIG. 10.

More particularly, ladder 40 has the ability to automatically return to its safety configuration (FIG. 10) from its ladder configuration (FIG. 12). In an exemplary embodiment, this is accomplished by a spring and damper mechanism as shown in FIG. 18. In one exemplary embodiment, spring and damper 57 are attached to elongated member 46 and are positioned on a lower ladder step 54 as illustrated in FIG. 18. Actuation of handles 44 translates elongated member 46 downwards such that safety blocks 52 recede inwards. When elongated member 46 is translated downward, spring 58 is compressed by a lower end of elongated member 46. Upon release of handles 44, spring 58 biases elongated member 46 upwardly and thereby urges a transition back to the safety configuration. As elongated member 46 translates upwards, safety block 52 moves within groove 48 and returns to its safety configuration.

Damper 57 acts against the bias of spring 58 limits the speed with which the biasing force of spring 58 translates elongated member 46 as shown in FIG. 18. In an exemplary embodiment, the counteracting force of damper 57 is calibrated to permit ladder 40 to return to its safety configuration only after a predetermined length of time. This time delay prevents safety blocks 52 from abruptly returning to their safety configuration (FIG. 10) immediately upon release of handles 44 by user 1. This gives user 1 time to safely ascend or descend ladder 40 via steps 54 before ladder 40 returns to its safety configuration.

Figure 20:
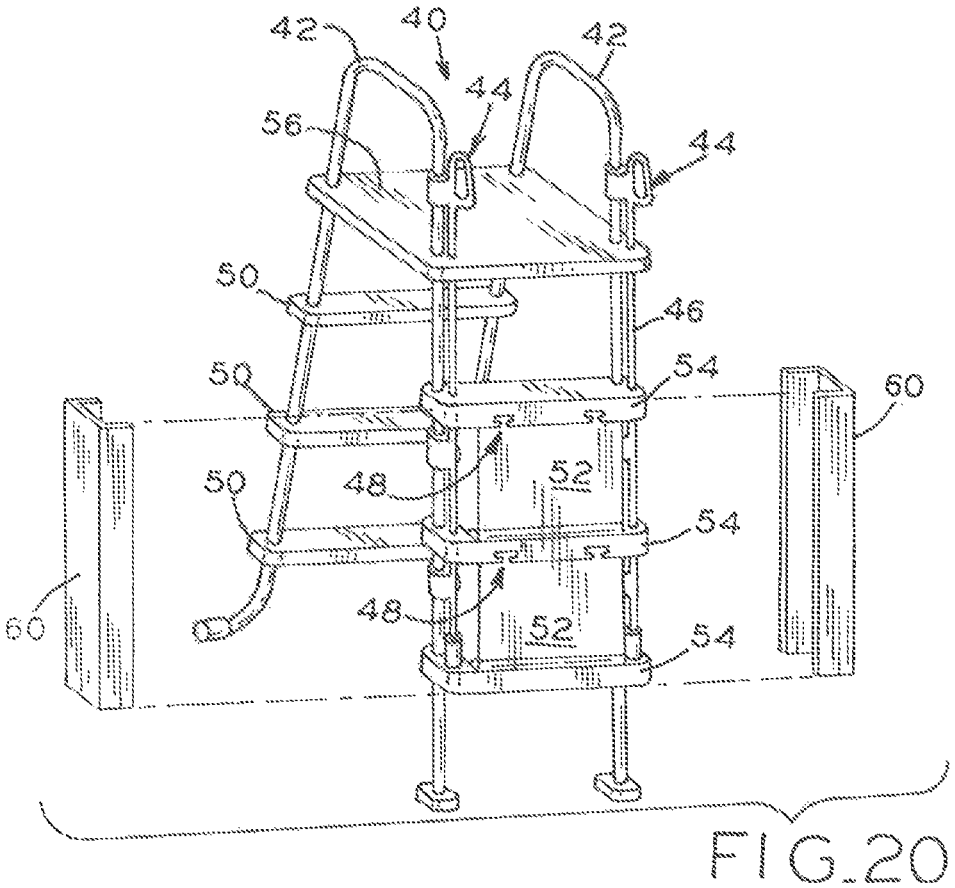
FIG. 20 is an exploded perspective view of the pool ladder of FIG. 10, illustrating guard rails.
Figure 21:
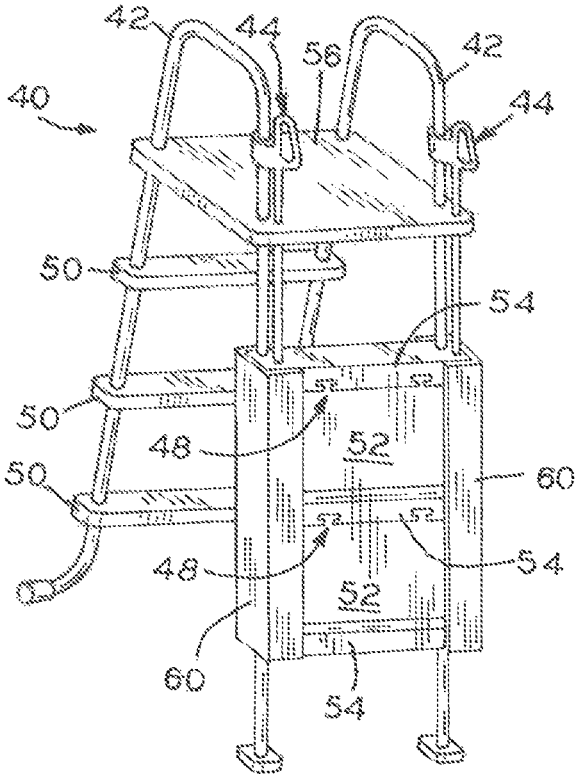
FIG. 21 is an assembled perspective view of the pool ladder of FIG. 20, including the guard rails.

In an exemplary embodiment shown in FIGS. 20 and 21, guard rails 60 are assembled to ladder 40. Guard rails 60 securely attach to left and rights ends of ladder steps 54 and cover steps 54, elongated member 46, linkage 53, spring 38, and damper 36. Guard rails 60 further limit purchase along the sides of steps 54, and prevent access to moveable components of the actuation mechanism. As such guard rails 60 prevent a user (e.g., child 1') from climbing exposed side portions of ladder step 54 by covering the exposed surfaces. In an exemplary embodiment, guard rails 60 have smooth, low-friction exposed surfaces to further discourage any attempts to climb pool ladder 40 when in the safety configuration.

While this invention has been described as having exemplary designs, the present disclosure can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A ladder assembly configured for placement on a ground, the ladder assembly comprising:

a left upright having an upper end;

a right upright cooperating with the left upright to define a lateral gap, the right upright having an upper end;

a lower ladder step having an upper step surface, the lower ladder step coupled to the left upright and the right upright and spanning the lateral gap;

an upper ladder step having an upper step surface, the upper ladder step coupled to the left upright and the right upright, spanning the lateral gap, and cooperating with the lower ladder step to define a vertical gap;

a safety block disposed above the lower ladder step, the safety block being moveable in a movement relative to the left upright and the right upright between:

a safety configuration in which the safety block spans the lateral gap and the vertical gap and directly covers the upper step surface of the lower ladder step, and a ladder configuration in which the upper step surface of the lower ladder step is exposed, extends generally parallel to the ground, and faces upward, whereby a user cannot step on the upper step surface of the lower ladder step when the safety block is in the safety configuration and the user can step on the upward-facing upper step surface of the lower ladder step when the safety block is in the ladder configuration; and a handle positioned above at least one of the upper end of the left upright and the upper end of the right upright, wherein the handle is configured to drive the movement of the safety block between the safety configuration and the ladder configuration.

2. The ladder assembly of claim 1 further comprising:

a linkage operably connected to the safety block and the handle such that actuation of the handle toggles the safety block from the safety configuration to the ladder configuration.

3. The ladder assembly of claim 2, further comprising:

a spring operably connected to the handle such that actuation of the handle causes the spring to compress; and a damper coupled with the spring such that the damper acts to limit a rate of spring extension to thereby automatically delay return of the ladder assembly from the ladder configuration to the safety configuration.

4. The ladder assembly of claim 1, wherein the upper ladder step and the safety block are integrally formed as a single component in which an upper surface of the safety block defines the upper step surface of the upper ladder step.

5. The ladder assembly of claim 4, further comprising:

a motion member operably connected to the handle and the safety block, such that actuation of the handle actuates the motion member such that the safety block moves between the safety configuration and the ladder configuration.

6. The ladder assembly of claim 5, wherein the motion member is parallel with at least one of the left upright and the right upright.

7. The ladder assembly of claim 5, further comprising:

a spring operably connected to the handle such that when the handle is actuated the spring is compressed and when the handle is released the spring biases the safety block into the safety configuration; and a damper coupled with the spring such that the damper acts against the bias of the spring when the safety block is returning to the safety configuration.

8. The ladder assembly of claim 5, wherein the safety block is rotatably coupled to the motion member and rotatably coupled to the left and right uprights such that movement of the motion member relative to the left and right uprights rotates the safety block.

9. A ladder assembly configured for placement on a ground, the ladder assembly comprising:

a fixed portion comprising:

a first left upright;

a first right upright cooperating with the first left upright to define a first lateral gap;

a ladder step having an exposed upper step surface, the ladder step coupled to the first left upright and the first right upright, the ladder step spanning the first lateral gap;

a moveable portion comprising:

a second left upright;

a second right upright cooperating with the second left upright to define a second lateral gap;

a first safety block rotatably attached to the second left upright and the second right upright, the first safety block having a top step surface and a bottom surface, the first safety block being moveable in a movement relative to the second left upright and the second right upright between:

a safety configuration in which the top step surface of the first safety block is unexposed, and a ladder configuration in which the top step surface of the first safety block is exposed, extends generally parallel to the ground, and faces upward, whereby a user cannot step on the top step surface when the first safety block is in the safety configuration and the user can step on the upward-facing exposed top step surface when the first safety block is in the ladder configuration;

a motion member rotatably attached to the first safety block and having a stationary major longitudinal axis such that longitudinal movement of the motion member occurs along and collinear with the stationary major longitudinal axis of the motion member and rotates the first safety block between the ladder configuration and the safety configuration, wherein the bottom surface of the first safety block is configured to rotate inwardly towards the fixed portion to form the ladder configuration.

10. The ladder assembly of claim 9, further comprising a second safety block rotatably attached to the second left upright and the second right upright, the second safety block rotatably attached to the motion member such that movement of the motion member rotates the second safety block.

11. The ladder assembly of claim 10, further comprising:

a handle operably connected to the first safety block and the second safety block such that actuation of the handle toggles the first safety block and the second safety block simultaneously between a ladder configuration and a safety configuration.

12. The ladder assembly of claim 11, wherein the handle is coupled to the motion member.

13. The ladder assembly of claim 12, further comprising:

a spring operably connected to the handle such that when the handle is actuated the spring is compressed and when the handle is released the spring biases at least one of the first safety block and the second safety block into the safety configuration; and a damper coupled with the spring such that the damper acts against the bias of the spring when the at least one of the first safety block and the second safety block is returning to the safety configuration.

14. The ladder assembly of claim 9, further comprising a platform spanning the first lateral gap and the second lateral gap.

15. The ladder assembly of claim 9, wherein the first safety block has an inner surface that faces inwardly towards the fixed portion and an outer surface that faces outwardly away from the fixed portion, wherein a height of the first safety block between the top step surface and the bottom surface exceeds a depth of the first safety block between the inner surface and the outer surface.

16. The ladder assembly of claim 15, wherein:

the top step surface of the first safety block is parallel to the bottom surface of the first safety block; and the inner surface of the first safety block is parallel to the outer surface of the first safety block.

17. A ladder assembly configured for placement on a ground, the ladder assembly comprising:

a fixed portion comprising:

a first left upright;

a first right upright cooperating with the left upright to define a first lateral gap;

a ladder step coupled to the left upright and the right upright and spanning the lateral gap;

a moveable portion comprising:

a second left upright having an upper end;

a second right upright cooperating with the second left upright to define a second lateral gap, the second right upright having an upper end;

a lower ladder step having an upper step surface, the lower ladder step coupled to the second left upright and the second right upright, the lower ladder step spanning the second lateral gap;

an upper ladder step having an upper step surface, the upper ladder step coupled to the second left upright and the second right upright, spanning the second lateral gap, and cooperating with the lower ladder step to define a vertical gap;

a safety block disposed above the lower ladder step, the safety block being moveable in a movement relative to the second left upright and the second right upright between:

a safety configuration in which the safety block spans the second lateral gap and the vertical gap and covers the upper step surface of the lower ladder step, and a ladder configuration in which the upper step surface of the lower ladder step is exposed, extends generally parallel to the ground, and faces upward, whereby a user cannot step on the upper step surface of the lower ladder step when the safety block is in the safety configuration and the user can step on the upward-facing upper step surface of the lower ladder step when the safety block is in the ladder configuration; and a motion member positioned outward of at least one of the second left upright and the second right upright such that the motion member is farther away from the fixed portion than the second left upright and the second right upright, the motion member rotatably attached to the safety block and having a stationary major longitudinal axis such that longitudinal movement of the motion member occurs along and collinear with the stationary major longitudinal axis of the motion member and rotates the first safety block between the ladder configuration and the safety configuration.

18. The ladder assembly of claim 17, further comprising:

a handle coupled to the motion member, wherein the handle is configured to drive the longitudinal movement of the motion member.

19. The ladder assembly of claim 18, further comprising:

a spring operably connected to the handle such that when the handle is actuated the spring is compressed and when the handle is released the spring biases the safety block into the safety configuration; and a damper coupled with the spring such that the damper acts against the bias of the spring when the safety block is returning to the safety configuration.

20. The ladder assembly of claim 17, wherein the lower ladder step has a bottom surface, an inner surface that faces inwardly towards the fixed portion, and an outer surface that faces outwardly away from the fixed portion, wherein a height of the lower ladder step between the upper step surface of the lower ladder step and the bottom surface exceeds a depth of the lower ladder step between the inner surface and the outer surface.

21. The ladder assembly of claim 20, wherein:

the upper step surface of the lower ladder step is parallel to the bottom surface of the lower ladder step; and the inner surface of the lower ladder step is parallel to the outer surface of the lower ladder step.

* * * * *